United States Patent [19]

Sodini

[11] 4,415,837

[45] Nov. 15, 1983

[54] STARTING CIRCUIT FOR GASEOUS DISCHARGE LAMPS

[75] Inventor: Gregory L. Sodini, Memphis, Tenn.

[73] Assignee: International Telephone and Telegraph Corporation, New York, N.Y.

[21] Appl. No.: 340,192

[22] Filed: Jan. 18, 1982

Related U.S. Application Data

[63] Continuation-in-part of Ser. No. 318,466, Nov. 5, 1981, abandoned.

[51] Int. Cl.[3] ..... H05B 37/00

[52] U.S. Cl. ..... 315/177; 315/207; 315/276; 315/289; 315/DIG. 5

[58] Field of Search ..... 315/207, 208, 289, 276, 315/DIG. 5, 243, 177

[56] References Cited

U.S. PATENT DOCUMENTS 3,889,152 6/1975 Bodine et al. ..... 315/208

3,963,958 6/1976 Nuckolls ..... 315/DIG. 5

4,005,336 1/1977 Casella ..... 315/243

4,143,304 3/1979 Hitchcock ..... 315/276

*Primary Examiner*—Harold Dixon

*Attorney, Agent, or Firm*—James B. Raden; Marvin M. Chaban

[57] ABSTRACT

A starting circuit for a high intensity discharge lamp. To provide the high voltage necessary for starting the lamp, the circuit uses a tapped transformer feeding a resistance-capacitance charging network coupled across the lamp. A voltage sensitive symmetrical switch is located in the network between the transformer tap and the RC junction to trigger the circuit when the open circuit voltage of the ballast is at its peak. A diode within the network is in series with resistance to allow current to flow during one half cycle of the cycle allowing the use of an inexpensive resistor in the RC network. A bleed resistor is placed in shunt of the capacitor to stabilize the triggering time of the network.

7 Claims, 6 Drawing Figures

STARTING CIRCUIT FOR GASEOUS DISCHARGE LAMPS

RELATED APPLICATIONS

The present application is a continuation-in-part of copending application Ser. No. 318,466 filed Nov. 5, 1981 and now abandoned.

BACKGROUND OF THE INVENTION

Gaseous discharge lamp starting circuits are well-known in the art. For example, U.S. Pat. Nos. 3,917,976 and 3,963,958 both to Nuckolls; No. 2,575,001 to Bird; No. 3,364,386 to Segawa et al; and No. 3,522,475 to Hashimoto. All these reference patents show the use of an RC circuit with a ballast transformer to provide high voltage pulses.

The references show many variations in the use of starting circuits. The Nuckolls patents show the use of RC networks on the output of a ballast transformer with a tapped portion of transformer aiding in the production of the high voltage starting voltage. A neon glow lamp provides a voltage sensitive breakdown path to the tapped turns enhancing the buildup of voltage. The Bird patent shows the use of a capacitor in series with the lamp and a diode in series with a resistor across the lamp to produce a voltage doubling action on the lamp. The Segawa patent shows a RC circuit plus switching element across the tapped turns at the input side of the transformer, as does the Hashimoto patent.

SUMMARY OF THE INVENTION

The starting circuit of the present invention provides a circuit having lower power requirements than the known and generally used starting circuits. By the use of low power in reaching the voltage level necessary for starting a high pressure discharge lamp, durability of the circuit is increased and the need for high priced components is reduced.

Thus, it is an object of the present invention to provide a lamp starting circuit which is activated when an A.C. voltage threshold is reached and which uses direct current for the starting function once the threshold level has been reached.

In addition, there is provided means for discharging the storage capacitor of the starting circuit during each cycle to provide greater consistency of operation.

By the use of the features noted above, the circuit of the present invention provides more stable, dependable operation than the known circuits using low cost components.

The starting network disclosed herein in usable with transformers of a number of types such as reactor transformer, constant wattage transformers (either isolating or autotransformer type) ferroresonant or lag ballast arrangements.

DETAILED DESCRIPTION OF THE DRAWINGS

Figure 1:
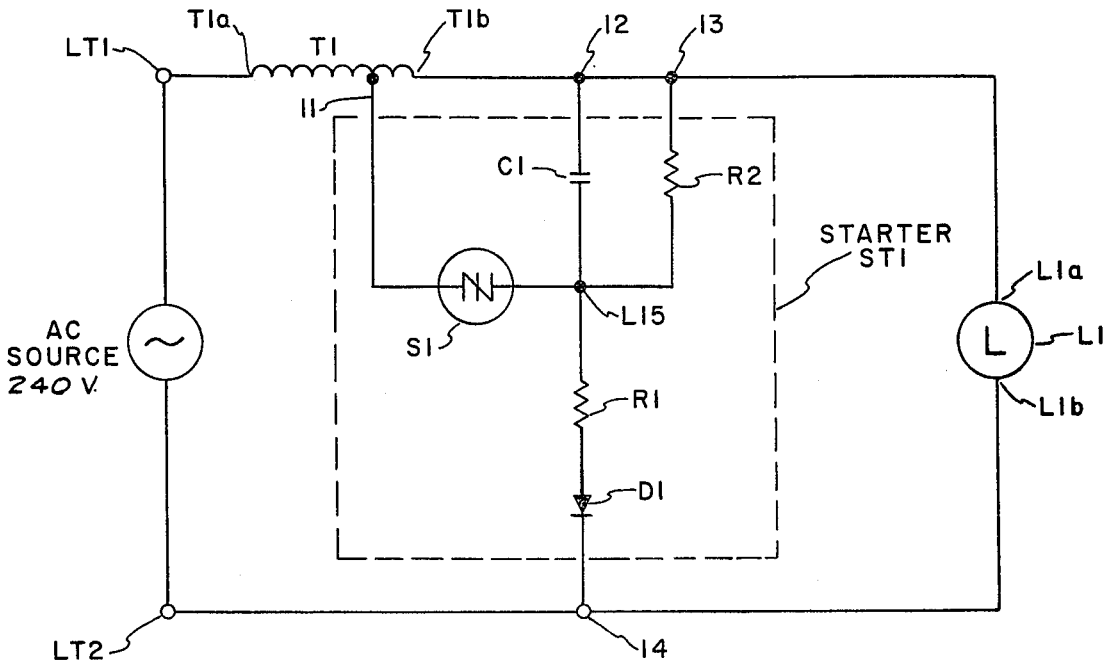
FIG. 1 is a circuit diagram of one embodiment of the invention employing a reactor transformer.

In FIG. 1, I show a first embodiment of a starting circuit for a gaseous discharge lamp L1. The lamp may be a sodium or other metal vapor lamp which requires a high voltage pulse for lamp ignition and uses a lower voltage which in this case may be approximately 100 volts for continued operation of the lamp, once ignited.

The starting circuit is powered from a source of AC power fed to the line terminals LT1 and LT2 of the circuit. The source of power may be a conventional 240 volt AC power source.

Connected in series in the conductor from one source terminal LT1 is one terminal T1*a* of a reactor type ballast transformer T1. The other outside terminal T1*b* of the transformer is connected to one terminal L1*a* of the lamp L1, the other lamp terminal L1*b* being connected to the source terminal LT2 to place the lamp essentially across the power source.

To derive high voltage starting pulses from the source for activating the lamp, high voltage starter ST1 is essentially connected across the source using four terminals 11–14. Within the starter ST1 and connected directly across the line at the output terminal T1*b* of the transformer T1 at terminal 12 is a series resistance-capacitance RC network comprised of capacitor C1 and resistor R1. A diode D1 in series with the RC network has its anode connected to the resistor R1 and its cathode connected to terminal 14 and terminal LT2. Across the capacitor C1 is a bleed resistor R2 whose function will be described further herein. Terminal 11 of the starter circuit is connected to an intermediate tap on the reactor transformer T1 to place a bilateral symmetrical voltage sensitive switch S1 between the transformer tap terminal and the junction between capacitor C1 and resistor R1 in the RC network.

A switching device suitable for use as the switch S1 would be that known and sold under the name Sidac by a number of electronic suppliers such as the General Electric Co. and by Shindengen Electric Mfg. Co. Ltd. of Tokyo, Japan. A suitable device would be one having a break over or switching voltage of above 115 volts, suchas 125 volts.

In the operation of the circuit of FIG. 1, the capacitor C1 and resistor R1 form an RC timing network. The RC network enables the switching device S1 to switch from its open circuit condition to a virtual short circuit or closed condition when the instantaneous open circuit voltage of the ballast transformer is at its peak. In this condition, the capacitor discharges through the tapped section of transformer T1 between terminals 11 and 12. The transformer acts as an autotransformer to boost the peak voltage to a level above 2500 volts to start the lamp.

Once started, the starter circuit is disabled and the lamp continues to operate from the AC source at a lower operating voltage.

The function of the diode D1 during the starting period is to restrict the voltage in the RC network to direct current during the positive half cycle, the voltage in the d.c. circuit being reduced to 0.707 of its AC value, the power requirements being approximately ½ of the equivalent AC circuit. During the negative half cycles of the AC input, the diode D1 blocks current flow to the RC path.

The advantages of the circuit of FIG. 1 may be summarized as follows:

(1) Resistor R1 may use any convenient type of resistor such as carbon composition or metal oxide. Wire wound resistors are not required as is the case with most competitive starting systems available. As is generally known, voltage transients are generated in starting circuits. Wire wound resistors break down easily due to transients. Other types of resistors such as those noted above can readily withstand transients, thus, the ability of the circuit to function with resistors other than wire-wound reduces its cost and raises its reliability.

(2) By using the diode in the RC network the power transmitted through the network is halved, thereby lessen the temperature at which the resistor R1 operates. In this way, the reliability of resistor R1 is materially increased.

(3) The current into and out of the capacitor C1 is direct current. With direct current, there are no zero crossings thereby lessening the stress on the capacitor. Once the lamp has been started, voltage across the capacitor is maintained at a constant d.c. level further minimizing operating stress on the capacitor.

Thus, all three listed advantages raise the reliability and operating life of the starting circuit.

The resistor R2 is positioned across the capacitor C1 for two reasons:

(1) Resistor R2 acts as a bleeder resistor to provide a discharge path for capacitor C1.

(2) In the circuit having the diode D1 in series with the RC network, AC current is blocked in the reverse direction. After the last high voltage spike is generated in a given half cycle, there will be a net d.c. voltage stored on the capacitor. During the negative half cycle the capacitor cannot discharge due to the blocking diode D1, and the voltage on the capacitor is retained into the next positive half cycle. Since the starting circuit is a multiple pulsing design, a triggering problem would be presented in the absence of resistor R2. As line voltage varies, the number of pulses generated varies from 1 to 2 to 3. Since these pulses occur at different voltage levels on the open circuit voltage waveform, the net d.c. voltage stored in capacitor C1 varies as the number of pulses changes. It could be said that the d.c. voltage stored in capacitor C1 is a function of the number of pulses. Since the triggering time of the network is dependent not only on the RC timing constant but also the initial stored voltage of the capacitor, the triggering time of the circuit becomes a function of the d.c. voltage stored on the capacitor and therefore a function the number of pulses. In order to eliminate this problem, R2 is used to provide a discharge path for C1 during the negative half cycle. There is virtually no inital stored charge on capacitor C1 at the beginning of each new positive half cycle, thus a relatively constant triggering time is produced.

Within the circuit of FIG. 1 as shown, the components used may be as follows:

Transformer Ratio (tapped Windings to total windings)—1:40
Switch S1—125 Volts Sidac (Shindengen Elect.)
Capacitor C1—0.15 uf a 400 v (min 0.12 ufd.)
Resistor R1—8.2 k ohms
Diode D1—IN4005
Resistor R2—56 k,½ watt FIG. 2 differs from FIG. 1 in that lamp L2 is of the type requiring 55 volts for continued operation from a 115 volt source. In this circuit, the starter ST2, provides a high frequency choke coil I with inductance of at least 30 millihenries in series with the RC-diode circuit. In this embodiment, the resistance of R12 is 1800 ohms; capacitor C2 has a minimum of 36 ufd capacitance, and the inductance of the tapped windings of T1 is at least 3 millihenries. The windings ratio for T1 is the same as that of FIG. 1. AT 60 Hz, the choke coil inductor presents very little impedance to the circuit. When the high frequency (100,000 hz) starting pulse is generated, in the manner described for FIG. 1, the impedance of the inductor L1, (which is 10 times that of the resistance of R22 must be 18.8 k ohms,) being frequency sensitive, becomes very high. The energy discharged by capacitor C1 will be blocked from going to ground, making for a much more efficient system.

Figure 2:
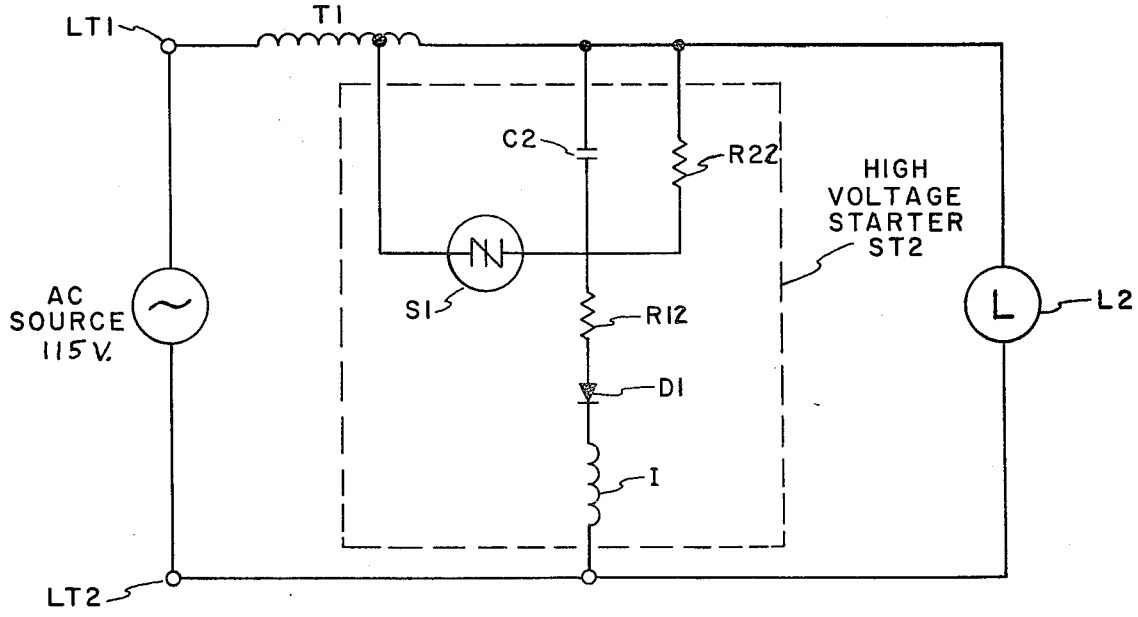
FIG. 2 is a circuit diagram of a second embodiment of the invention also employing a reactor transformer.

In the circuit of FIG. 2, the values of components may differ from those of FIG. 1 to the extent noted above, however the method of operation remains otherwise the same.

Figure 3:
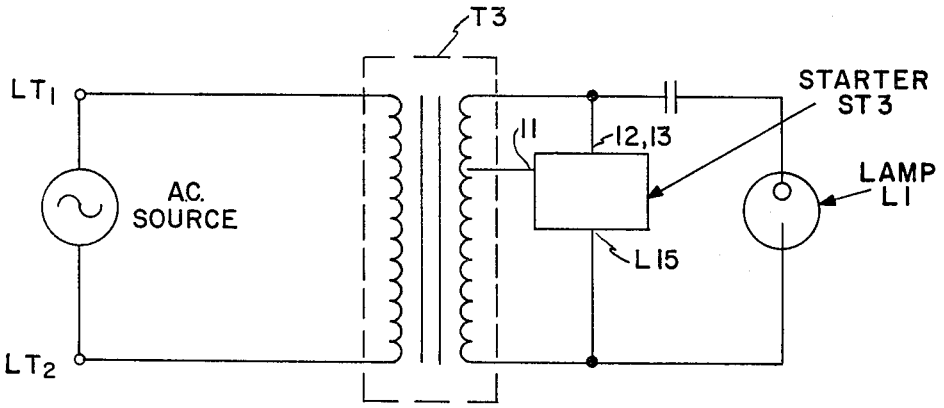
FIG. 3 is a circuit diagram of a third embodiment of the invention employing a constant wattage regulating ballast transformer.

In FIG. 3 is shown a circuit in which the lamp is isolated from the source through a constant wattage transformer T3 with its primary across the source and the lamp L1 across the transformer secondary. The starter network ST3 is identical to network ST1 in the location of components and method of operation, however, the component values may be different in network ST3.

As in FIG. 1, the starting network ST3 has one input 11 at a tapped connection to the secondary of the constant wattage transformer and its other leads across the lamp L1.

Figure 4:
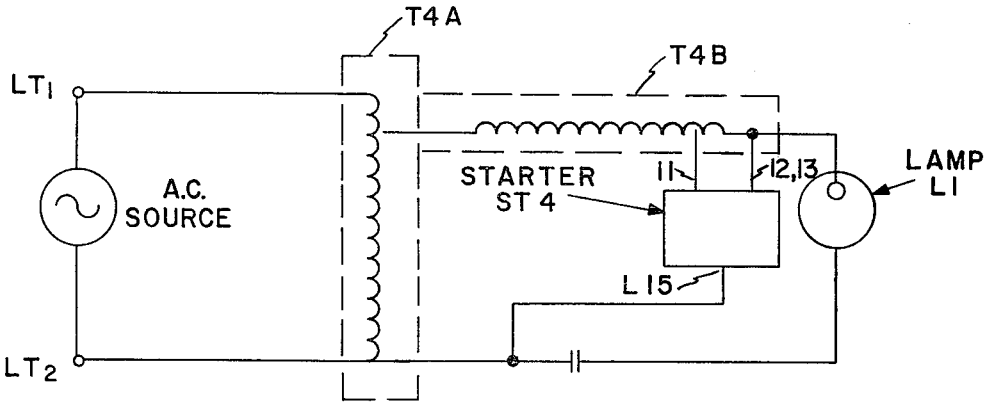
FIG. 4 is a circuit diagram of a fourth embodiment of the invention employing a constant wattage autotransformer.

In FIG. 4, I show a constant wattage autotransformer T4, a non-isolated version of the circuit of FIG. 3. The starting network ST4 is identical in component location to circuit ST1 and only differs in value of components.

Figure 5:
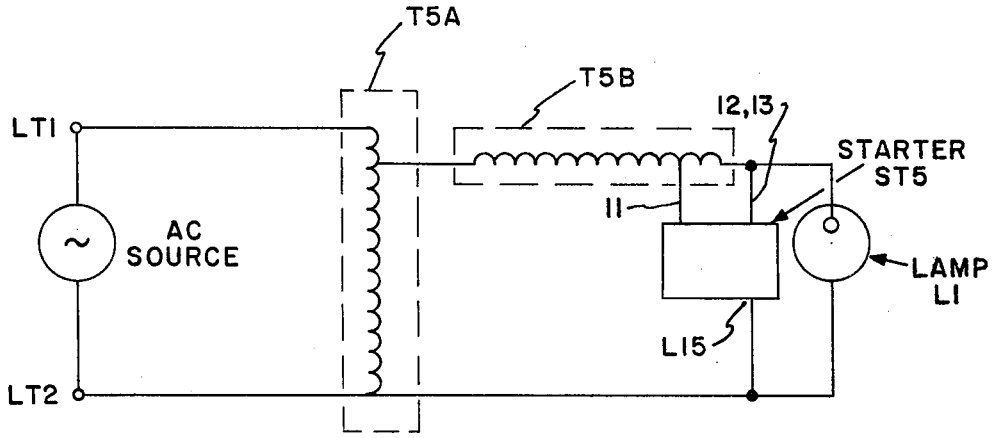
FIG. 5 is a circuit diagram of a fifth embodiment of the invention employing a lag ballast.

FIG. 5 shows a starting network ST5 in a lag ballast arrangement. An auto transformer winding T5A is connected across the A.C. source and a reactor transformer is coupled to a tapped intermediate point of the autotransformer. As is commonly known, the auto transformer and reactor windings may both be wound on a common core. A starter network ST5 is connected to an intermediate tap of the reactor transformer. As in the prior circuits, the starter network includes the circuit elements of circuit ST1 of FIG. 1,i.e., an R-C delay circuit with a diode in series with R-C delay, a symmetrical bilateral switch and a bleed resistor.

Figure 6:
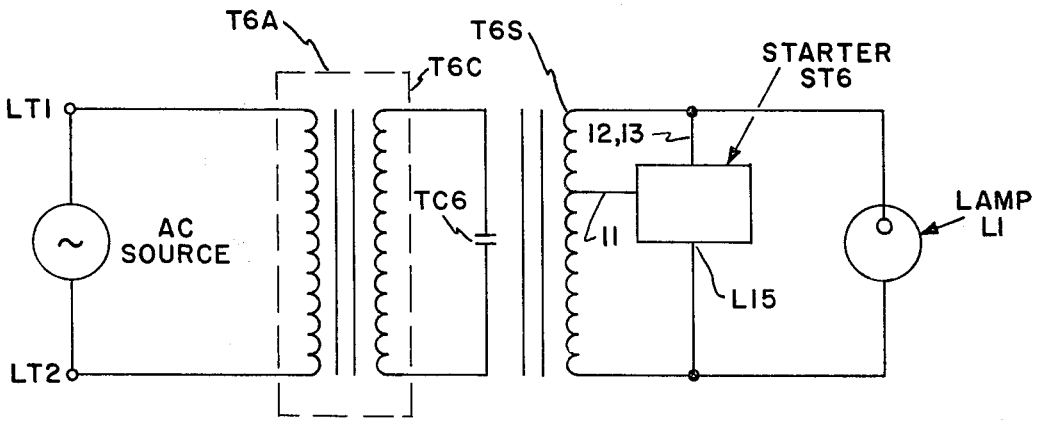
FIG. 6 is a circuit diagram of a sixth embodiment of the invention employing a ferroresonant transformer.

FIG. 6 shows the use of the starting network labelled ST6 for FIG. 6 having the components of ST1 tapped into the secondary of a ferroresonant transformer. This transformer is a regulating type of transformer having a constant voltage transformer and an inductor. This circuit uses the inductor TC6 and a tank capacitor TC6 to regulate power to the lamp while maintaining a constant input voltage during variations in circuit input voltage.

For all these circuits, the starting network ST3 - ST6 is identical in component location to the components of starter ST1 of FIG. 1 and have the respective starter lead 11 coupled to a tap in the transformer of the respective circuit to produce the same ratio previously noted relative to FIG. 1.

I claim:

1. A circuit for starting and operating a high intensity discharge lamp having at least two electrodes from a source of alternating current, means coupling said lamp across said source, said coupling means comprising a transformer with its output winding in series with the lamp and a starting network connected at the output end of the transformer output winding, said starting network including a series circuit comprising a capacitive member and a resistance member in series with one another with a junction terminal therebetween, said series circuit connected across the lamp, a voltage sensitive symmetrical switch connected from said junction terminal to an intermediate tap in said transformer output winding to discharge said capacitive member through the switch and the transformer section between the tap into said transformer output winding and the output end thereof to generate a high voltage charge to said lamp when the voltage across the switch rises above a predetermined threshold starting level for the lamp, and a diode in series with the members of said series circuit for limiting the charging of said capacitive member to unidirectional current flow during alternate half cycles of said alternating current whereby to limit the starting power applied to said lamp.

2. A starting and operating circuit as claimed in claim 1 in which there is a bleeder resistor connected directly across said capacitive member to provide a bleed discharge path from said capacitive member.

3. A starting and operating circuit as claimed in claim 1 in which said starting network includes an inductor in series with the components of said series circuit.

4. A starting and operating circuit as claimed in claim 1 in which said transformer output winding includes said tapped section and another section between the tap terminal and the coupling to said source, and in which the turns ratio of said other section to said tapped section is approximately forty to one.

5. A starting and operating circuit as claimed in claim 1 in which said transformer is a reactive transformer.

6. A starting and operating circuit as claimed in claim 1 is a ferroresonant transformer.

7. A starting and operating circuit as claimed in claim 1 in which said transformer includes a primary winding across said source and said output winding comprises the secondary winding of said transformer.

* * * * *